United States Patent [19]

Goncalves

[11] Patent Number: 4,693,366

[45] Date of Patent: Sep. 15, 1987

[54] PACKAGING MEANS IN TWO PARTS

[75] Inventor: Antonin Goncalves, Groslay, France

[73] Assignee: The French Joint Stock Company "L'Oreal", France

[21] Appl. No.: 947,381

[22] Filed: Dec. 29, 1986

[30] Foreign Application Priority Data

Jan. 10, 1986 [FR] France ..... 86 00277

[51] Int. Cl.[4] ..... B65D 25/08

[52] U.S. Cl. ..... 206/222; 215/DIG. 8; 222/80

[58] Field of Search ..... 206/222; 215/DIG. 8; 222/83, 85, 80

[56] References Cited

U.S. PATENT DOCUMENTS 4,465,183 8/1984 Saito et al. ..... 206/222

4,638,927 1/1987 Morane ..... 206/222 X

*Primary Examiner*—William Price

*Attorney, Agent, or Firm*—Cushman, Darby & Cushman

[57] ABSTRACT

A packaging means is formed in two parts which can be assembled. The first part is constituted by two compartments comprising a first compartment or container, and a second compartment or cap surmounting the first, these two compartments being separated from each other by two diaphgrams. An intermediate part of the first part joins the two compartments. The two diaphragms are fixed to the cap which is closed at its upper portion by a stopper. The second part of this packaging means is constituted by a perforator cap capable of perforating the diaphragms when it is placed in position on the second compartment.

The packaging means of this type is particularly convenient for the preservation of two products independently of each other before they are mixed for use.

16 Claims, 4 Drawing Figures

PACKAGING MEANS IN TWO PARTS

FIELD OF THE INVENTION

The present invention relates to packaging means in two parts; the first part is constituted by two compartments separated from each other by a frangible diaphragm; the second part is constituted by a perforator cap. Such packaging means makes it possible to conserve at least two products independently of each other and to effect their mixing only at the time they are used.

PRIOR ART

Bottles are already known which have two compartments disposed on top of each other, each being provided with a frangible diaphragm at its end facing the other compartment; such bottles comprise an intermediate cylindrical element integral with the upper compartment, and screwing on to the lower compartment. The upper compartment can contain cutter blades integral with its wall; the lower compartment can also contain a cutter ring situated on the upper edge of its lateral wall. During screwing of this intermediate element on to the lower compartment, the cutter blades, as well as any such cutter ring, tear the diaphragms and thus bring the products contained in each one of the compartments into contact.

Such a bottle has been described in particular in EP-A-99754. Another type of bottle including substantially the same elements, in particular for cutting the diaphragm separating the two compartments, is disclosed in EP-A-101594.

It should be noted that in these prior art bottles it is necessary to screw one of the compartments on to the other either directly or through the intermediary of a part which is integral with this other compartment, or to exert a force on one of them towards the other in order to perforate the diaphragm or diaphragms separating the two compartments. Now the users may, by not correctly apportioning the force or couple to be exerted, damage the bottle and in particular, the means ensuring the seal between the two compartments.

OBJECT OF THE INVENTION

It is the primary object of the present invention to provide a packaging means comprising more particularly two compartments separated by frangible diaphragms, which is straighforward to make and allows the products contained in each of these compartments to be preserved with a secure, reliable and controllable seal.

SUMMARY OF THE INVENTION

This and other objects which will be apparent from the description given below are attained by a packaging means in two parts which can be assembled, the first part being constituted by two compartments comprising a first compartment or container and a second compartment or cap surmounting the first, these two compartments being separated from each other by two diaphragms as well as by an intermediate part joining these two compartments, this packaging means being characterised in that the two diaphragms are carried by the second compartment, in that this second compartment is closed in its upper portion by a stopper, and in that the second part of this packaging means is constituted by a perforator cap capable of perforating these two diaphragms when it is positioned on the second compartment.

Preferably, the second compartment comprises at its lower portion, two concentric skirts; namely an inner skirt on which a first diaphragm is fixed and an outer skirt which is higher than the first, and on which the second diaphragm is fixed.

Advantageously, the first diaphragm is fixed to a base integral with the inner skirt.

Preferably, the first compartment comprises a neck provided with fastening means.

The intermediate part is constituted by a skirt, bearing on the two compartments, including fastening means cooperating with those of the neck of said first compartment, and means for fixing to the outer skirt of the second compartment.

Advantageously, the intermediate part has a vertical half cross-section in the shape of a horizontal T whose cross bar is constituted by the skirt and whose stem comprises fastening means.

Preferably, the fastening means of the neck are constituted by a catch-engagement ring and anti-back-off stops and those of the intermediate part which cooperate with the fastening means of the neck comprise a catch-engagement skirt and anti-back-off stops.

Advantageously, the intermediate part is fixed to the second compartment by catch-engagement of its skirt on the outer skirt of the second compartment.

In a preferred embodiment of the invention, the inner skirt of the second compartment lies in the extension of the wall of the second compartment.

Between the outer skirt and the inner skirt, there is situated an intermediate skirt to which the second diaphragm is also fixed.

Advantageously, an opening is arranged in the diaphragm wall between this intermediate skirt and this outer skirt.

Preferably, the ring and the neck provided with the catch engagement skirt of the intermediate skirt together delimit substantially coaxial openings which have substantially the same diameter.

The stopper of the second compartment is releasably screwed on to the second compartment.

The second part of this package, constituted by a perforator cap, can be screwed on to the cap instead of the stopper.

Preferably this perforator cap contains a cutter blade which can advantageously be semi-circular.

BRIEF DESCRIPTION OF THE DRAWINGS

The following description, which is not intended to be restrictive of the invention, should be read with reference to the attached drawings wherein:-

DESCRIPTION OF THE PREFERRED EMBODIMENT

Figure 1:
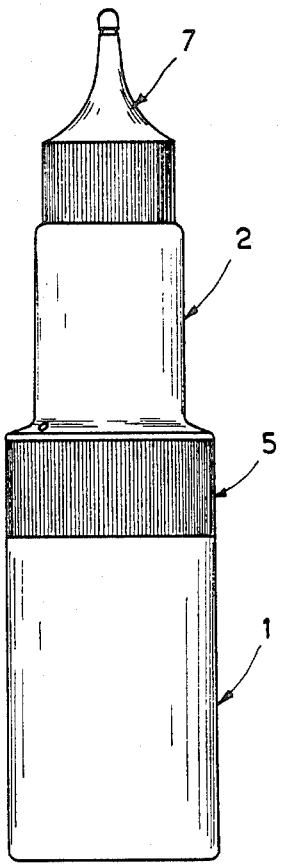
FIG. 1 shows an external view of the package in accordance with the present invention, when the perforator cap is in position.
Figure 2:
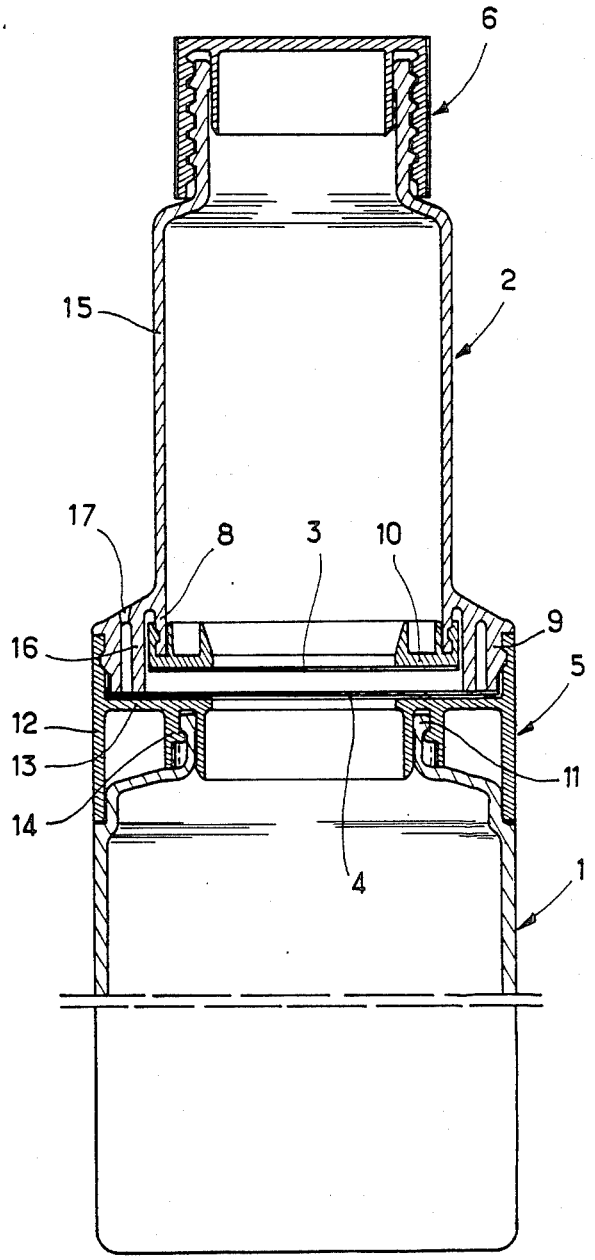
FIG. 2 is a vertical cross-section of this same package but in the storage configuration.
Figure 3:
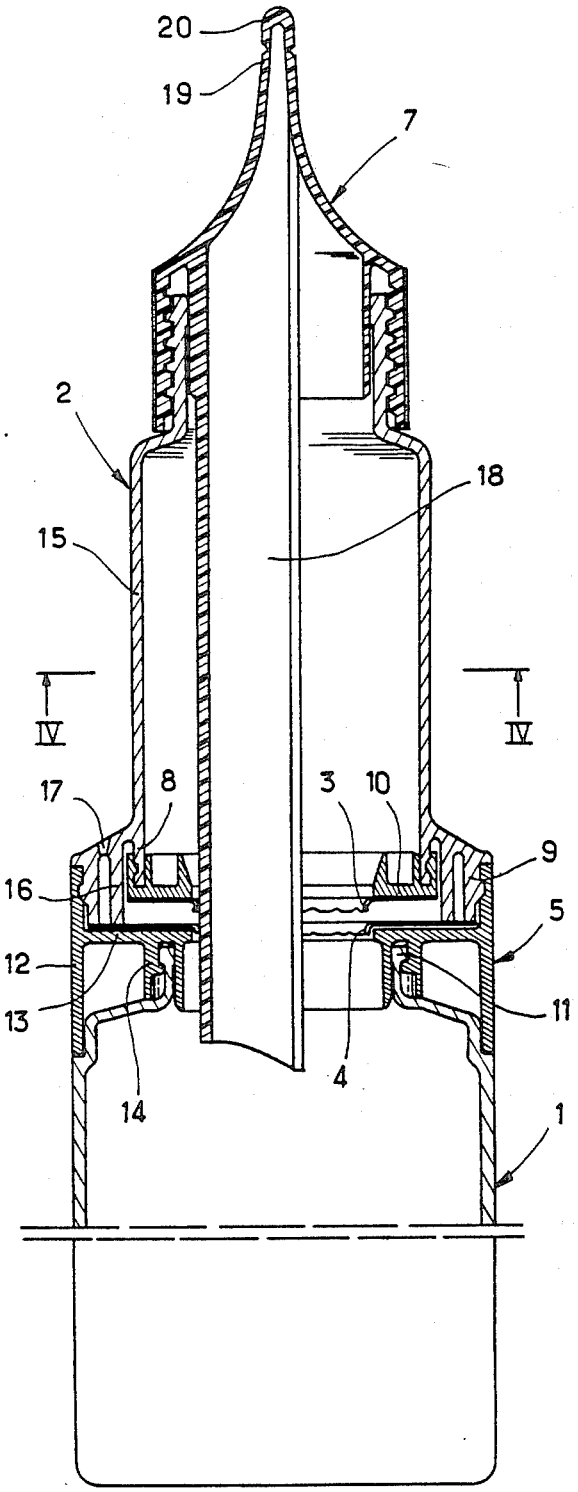
FIG. 3 is a vertical cross-section of the package of FIG. 1.
Figure 4:
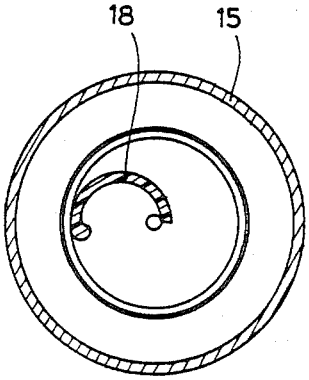
FIG. 4 is a transverse cross-section taken along line IV—IV of FIG. 3.

As may be seen in particular in FIGS. 1 and 2, a two part packaging means in accordance with the present invention comprises a first part which is constituted by two compartments, namely a first compartment or container 1, and a second compartment or cap 2 surmounting the first (these two compartments being separated from each other by two diaphragms 3 and 4), as well as by an intermediate part 5 joining these two compartments 1 and 2. The cap 2 is obturated in its upper portion by a stopper 6. The second part of this package is constituted by a perforator cap 7 which is capable of perforating the two diaphragms 3 and 4 when it is placed in position on the compartment 2 after removal of the stopper therefrom.

The cap 2 comprises in its lower portion two concentric skirts of which the inner skirt 8 is connected to a first diaphragm 3 and the outer skirt 9 projects axially outwardly beyond the first and is fixed to a second diaphragm 4.

In accordance with an advantageous embodiment of the present invention, the first diaphragm 3 is fixed to a ring 10 which is itself fixed to the inner skirt 8. The fixing between this ring 10 and the inner skirt 8 can be for example by catch-engagement.

The upper end of the container 1 comprises a neck 11 which is provided with fastening means.

The intermediate part 5 is constituted by a skirt 12 which engages the two compartments, that is to say the container 1 and the cap 2, and which is also provided with fastening means cooperating with those of the neck 11 and with means for fixing it to the outer skirt 9 of the cap 2.

In the present embodiment this intermediate part 5 has, in a vertical half cross-section, substantially the shape of a horizontal T whose cross bar is constituted by the skirt 12 and whose stem 13 comprises the means for fastening the intermediate part 5 to the neck 11.

For example, the fastening means to the neck 11 are constituted by a catch-engagement ring and anti-back-off stops.

Because of this very structure the intermediate part 5 and the container 1 become fixed to each other.

Moreover, the intermediate part 5 is fixed to the cap 2 by catch-engagement of its skirt 13 on the outer skirt 9 of the cap 2. Because of this, the intermediate part 5 and the cap 2 also become fixed to each other. As a result, the intermediate part 5 and the container 1 constitute an assembled unit which is equivalent to an integral bottle.

For reasons of manufacture it may be advantageous for the inner skirt 8 of the cap 2 to lie in the extension of the wall 15 of the cap.

The cap 2 also comprises, between the inner and outer skirts 3 and 9, an intermediate skirt 16 which is also fixed to the second diaphragm 4. An opening 17 is formed in the wall 15 of the cap 2 between the intermediate skirt 16 and the outer skirt 9.

It should be observed that the space delimited by the wall 15, the intermediate skirt 16, the outer skirt 9, and the second diaphragm 4, is other wise totally enclosed.

By means of the opening 17 it is, therefore possible to check the seal of the second diaphragm; it is of course possible to check the seal of the first diaphragm after it was fixed to the ring 10 but before the second diaphragm is installed.

In the "storage" configuration the cap 2 is closed in its upper portion by a stopper 6 which is preferably threaded. In the "use" configuration it must, therefore, be possible on the one hand, to mix the products contained separately in the container 1 and in the cap 2 and on the other hand to have available a stopper for controlling the discharge of the mixed product when it is dispensed. This is the reason why the package in accordance with the present invention comprises a second part which is constituted by a perforator cap 7.

In the "use" configuration it is therefore necessary to remove the stopper 6 and to replace it by the pperforator cap 7 which is screwed on to the upper portion of the cap 2. This perforator cap 7 is provided with a cutter blade 18 which, when the cap is positioned on the cap 2, slashes the two diaphragms 3 and 4 and cuts them in a circular manner as the cap 7 is screwed on to the cap 2. This cutter blade 18 has advantageously a semi-circular shape.

To facilitate cutting the diaphragms 3 and 4, it is preferable for the ring 10 and the neck 11 provided with its catch-engagement skirt 14 to delimit substantially coaxial openings and which have substantially the same diameter.

The perforator cap 7 is provided with a nozzle 19 obturated for instance by a stopper 20 which can, in particular, be opened by cutting off its tip. In the present embodiment, the container 1 is made of polyethylene whilst the cap 2 is made of polyvinyl chloride. The ring 10 as well as the intermediate part 5 are made of polypropylene and so are the stopper 6, the perforator cap 7 and its cutter blade. The two diaphragms 3 and 4 are preferably made of aluminium. the can therefore be heat-sealed to the ring 10 and to the intermediate skirt 16 and outer skirt 9.

The first part of the package in accordance with the present invention can, for instance, be assembled in the following sequence:

(a) The intermediate part 5 is catch-engaged on the neck 11 of the container 1 and this container is filled with a product such as an oxidizing agent.

(b) At this time, the first diaphragm 3 is welded to the ring 10 and the pressure retention of the weld is checked; this ring 10 is then catch-engaged on the internal skirt 8 of the cap 2. The second diaphragm 4 can then be welded to the intermediate skirt 16 and to the outer skirt 9 of this same cap 2 and the pressure retention of this weld is checked by means of the opening 17.

(c) The cap 2 thus provided with its two diaphragms is then catch-engaged on the intermediate part 5.

(d) The cap 2 is filled with its product, and the stopper 6 is screwed on.

A very slight clearance can be left between the second diaphragm 4 and the "stem" 13 of the intermediate part 5, to allow the possible evacuation of any gas emanating from the decomposition of the oxidizing agent in the container 1. In fact, if this oxidizing agent is oxygenated water, its decomposition generates oxygen which can create as excess pressure within the container detrimental to its conservation. However, because of the clearance described above, the oxygen can excape from the container 1 by way of this clearance and can pass between the outer skirt 9 of the cap 2 and the skirt 12 of the intermediate part 5; a micro-leakage is thus obtained.

The container 1 can be made of polyethylene; the stopper 6, the perforator cap 7, the ring 10 for supporting the first diaphragm 3, and the intermediate part 5, are all made of polypropylene. The cap 2 is made of polyvinyl chloride, whereas the diaphragms 3 and 4 are made of aluminium.

I claim:

1. In a packaging means comprising first and second parts which can be assembled together, said first part comprising:-

(a) a first compartment;

(b) a second compartment defining a cap surmounting the first compartment;

(c) first and second diaphragms separating first and second compartments from each other; and (d) an intermediate part joining the said first and second compartments;

the improvement wherein:-

(e) said two diaphragms are fixed to said second compartment;

(f) said second compartment is closed at its upper portion by a releasable stopper; and (g) said second part of the package is constituted by a perforator cap including means for perforating the first and second diaphragms when said perforator cap is placed in position on the second compartment.

2. A packaging means according to claim 1, wherein said second compartment comprises at its lower portion first and second concentric skirts; said first skirt having said first diaphragm fixed thereon and said second skirt being disposed radially outwardly of the first skirt and projecting axially beyond the first skirt, and wherein the second diaphragm is fixed on said second skirt.

3. A packaging means according to claim 2, wherein said first diaphragm is fixed to a support on said first skirt.

4. A packaging means according to claim 2, wherein said first compartment comprises a neck, and including fastening means on said neck.

5. A packaging means according to claim 4, wherein said intermediate part is constituted by a third skirt bearing on said first and second compartments, and includes fastening means cooperating with said fastening means on said neck of the first compartment, said packaging means further including cooperating fixing means on said intermediate part and on said second skirt of said second compartment.

6. A packaging means according to claim 5, wherein said intermediate part has, in a vertical cross-section, the shape of a horizontal T whose cross bar is constituted by the said skirt and whose stem includes said fastening means of the intermediate part.

7. A packaging means according to claim 4, wherein said fastening means of said neck are constituted by a catch-engagement ring and anti-back-off stops, and the fastening means of said intermediate part which cooperate with the said fastening means of the intermediate part comprise a catch-engagement skirt and anti-back-off stops.

8. A packaging means according to claim 5, wherein said cooperating fixing means on said third skirt and on said second skirt comprise catch-engagement means on said second skirt and on said third skirt of said intermediate part.

9. A packaging means according to claim 2, wherein said first skirt of the second corpartment is in the extension of the wall of said second compartment.

10. A packaging means according to claim 2, and further including an intermediate skirt on said second coxpartment situated between said second skirt and said first skirt thereof, wherein said second diaphragm is also fixed.

11. A packaging means according to claim 10, including means defining an opening in the wall of the second compartment between said intermediate skirt and said second skirt.

12. A packaging means according to claim 3, wherein said support to which said first diaphragm is fixed is a ring fastened to said first skirt, wherein said second compartment includes a neck adapted for catch-engagement with said intermediate part, and wherein said ring, said neck and said intermediate part all delimit substantially coaxial openings having substantially the same diameter.

13. A packaging means according to claim 1, wherein said stopper and said second compartment includes cooperating thread means.

14. A packaging means according to claim 13, wherein said perforator cap constituting said second part of said packaging means includes thread means allowing said perforator cap to be screwed on said second compartment instead of said stopper.

15. A packaging means according to claim 14, wherein said perforator cap comprises a cutter blade for cutting said diaphragms.

16. A packaging arrangement according to claim 15, wherein said cutter blade (18) is semi-circular.

* * * * *